US007057633B2

(12) United States Patent
Kojima et al.

(10) Patent No.: US 7,057,633 B2
(45) Date of Patent: Jun. 6, 2006

(54) THERMAL DEVELOPMENT RECORDING APPARATUS

(75) Inventors: Tetsuya Kojima, Kanagawa (JP); Nobuyuki Torisawa, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 99 days.

(21) Appl. No.: 10/770,571

(22) Filed: Feb. 4, 2004

(65) Prior Publication Data

US 2004/0156025 A1 Aug. 12, 2004

(30) Foreign Application Priority Data

Feb. 4, 2003 (JP) ..... P2003-027203

(51) Int. Cl.
*B41J 2/435* (2006.01)

(52) U.S. Cl. ..... 347/228

(58) Field of Classification Search ..... None
See application file for complete search history.

(56) References Cited

U.S. PATENT DOCUMENTS 3,207,896 A 9/1965 Meaney et al.
6,309,114 B1 * 10/2001 Torisawa et al. ..... 396/575
6,320,642 B1 * 11/2001 Ogawa et al. ..... 355/27
6,335,153 B1 * 1/2002 Toya ..... 430/350
6,891,557 B1 * 5/2005 Sumi et al. ..... 347/228
2002/0146654 A1 * 10/2002 Tsukada et al. ..... 430/617
2003/0190558 A1 * 10/2003 Shiraishi et al. ..... 430/350

FOREIGN PATENT DOCUMENTS

EP 0 546 190 A1 6/1993
EP 1 276 006 A1 1/2003
EP 1 325 813 A2 7/2003
JP 2000-284382 A 10/2000

* cited by examiner

*Primary Examiner*—Huan Tran
(74) *Attorney, Agent, or Firm*—Sughrue Mion, PLLC

(57) ABSTRACT

A thermal development recording apparatus has a recording portion for exposing a thermal development recording material to form a latent image, a thermal-developing portion for heating the thermal development recording material to execute a thermal development, and a cooling portion for cooling the thermal development recording material after the thermal development, which further has a temperature adjusting portion for adjusting a temperature of the thermal-developing portion based on temperature of the cooling portion. Therefore, the thermal development recording apparatus can maintain a density constant independent of the number of sheets of thermal development recording materials and also maintaining a color tone, whose change cannot be suppressed by adjusting an amount of exposure, constant to thereby stabilize both the density and the color tone.

11 Claims, 6 Drawing Sheets

THERMAL DEVELOPMENT RECORDING APPARATUS

BACKGROUND OF THE INVENTION

1. Field of the Invention

The present invention relates to a thermal development recording apparatus that is applied to a recording in a so-called dry system using the dry material, to which a wet process is not applied, by applying a heating process to the thermal development recording material.

2. Description of the Related Art

In the prior art, as the image recording apparatus such as the digital radiography system, CT, MR, etc. for recording the image for medical use, the wet system for obtaining the reproduced image by applying the wet process to the silver photographic photosensitive material after the photographing or recording is employed. In contrast, in recent years the recording system using the dry system in which the wet process is not executed is observed with interest. In such recording system, a film made of photosensitive and thermal recording material (photosensitive/thermal recording material) or thermal development photosensitive material (referred to as "thermal development recording material" hereinafter) is employed. Also, in the recording system using the dry system, a latent image is formed by irradiating (scanning) a laser beam onto the thermal development recording material in the exposing portion, then the thermal development is carried out in the thermal-developing portion by bringing the thermal development recording material into contact with a heating means, then such material is cooled, and then the thermal development recording material on which the image is formed is ejected to the outside of the apparatus. Such dry system can overcome the problem of the waste liquid processing in contrast to the wet process.

However, in the image recording apparatus in the prior art, such a problem existed that an inlet temperature of the cooling portion, etc. are changed by the successive processing of the thermal development recording material and as a result a density of the image is changed. In other words, a temperature in the cooling portion is increased by the successive processing of the thermal development recording material by a quantity of heat given by the thermal development recording material. Therefore, such a drawback is caused that the density of the image is thickened higher than a predetermined density. For this reason, the image recording apparatus in which the density of the image is not changed even when the thermal development recording materials are successively processed was proposed.

JP-A-2000-284382 is known as a related art.

The image recording apparatus disclosed in JP-A-2000- has a recording portion for forming the latent image by exposing the thermal development recording *material*, a controlling portion for executing the control of the recording *portion*, a *thermal-developing* portion for executing the thermal development by heating the thermal development recording material by virtue of the heating *medium*, and a cooling portion for cooling the thermal development recording material after the thermal *development*, and also includes a temperature sensor for measuring a temperature of the thermal development recording material before such material enter into the *thermal-developing portion*, a temperature sensor for measuring an inlet temperature of the cooling *portion*, and a *quantity-of-light* correcting circuit for correcting a quantity of recording light on the thermal development recording material based on outputs of these temperature *sensors*. A*ccording* to *quantity-of-light* correction of the *quantity-of-light* correcting *circuit*, a quantity of light is reduced smaller as the temperature of the thermal development recording material upon entering into the *thermal-developing* portion becomes higher and the inlet temperature of the cooling portion becomes higher after thermal *development*.

As a result, even though the number of sheets of the thermal development recording material is increased, the density can always be maintained constant.

However, in the above image recording apparatus, the density was maintained constant by reducing a quantity of light as the temperature of the thermal development recording material is increased higher and the inlet temperature of the cooling portion is increased higher. But sometimes a color tome was changed in such case. More particularly, the event that the temperature rise in the cooling portion is caused by the successive recording signifies that a thermal-developing time is substantially prolonged. Then, it became apparent that, because the thermal-developing time is extended, the color tone as the characteristic of the photosensitive material is changed. For example, as shown in FIG. 3A, the thermal development recording material on which the latent image is formed by the recording portion at the preceding stage enters into the thermal-developing portion, then such material is heated and reaches a development proceeding temperature at a time t10, and then proceed of the thermal development is started. Then, a temperature is increased, then the temperature is maintained constant by the temperature adjustment to exceed the development proceeding temperature, and then the thermal development recording material is transferred from the thermal-developing portion to the cooling portion. The proceed of the thermal development is stopped at a time t11 in the middle of this processing. In this case, a development proceeding time t1 of the thermal development recording material is given by t1=t11−t10. However, when the inlet temperature of the cooling portion is increased because of the successive processing of the thermal development recording material, a development proceed stopping time of the thermal development recording material becomes t21. As a result, the development proceeding time is prolonged by a difference of t21−t11 rather than the thermal development recording material whose development proceeds up to t1, and thus the color tone was changed correspondingly. That is, since the color tone depends on the thermal-developing time, it was impossible to maintain such color tone constant even if an mount of exposure is changed.

SUMMARY OF THE INVENTION

The object of the present invention is to provide a thermal development recording apparatus which is capable of maintaining a density constant without depending on the number of sheets of thermal development recording material and also maintaining a color tone, whose change could not be suppressed by adjusting an amount of exposure, constant to thereby stabilize both the density and the color tone.

The invention provides a thermal development recording apparatus having recording means for exposing a thermal development recording material to form a latent image, a thermal-developing means for heating the thermal development recording material to execute a thermal development, cooling means for cooling the thermal development recording material after the thermal development, and temperature adjusting means for adjusting a temperature of the thermal-developing means based on temperature of the cooling means.

The invention provides a thermal development recording apparatus, which sequentially carries a thermal development recording material, having recording means exposing the thermal development recording material to form a latent image, thermal-developing means for heating the thermal development recording material to execute a thermal development, cooling means for cooling the thermal development recording material after the thermal development, and carrying-speed adjusting means for adjusting a carrying speed of the thermal development recording material based on temperature of the cooling means.

Further, the thermal-developing means includes: a plurality of heating means, which are arranged to align in a feed direction of the thermal development recording material, for applying a heating process to the thermal development recording material at a predetermined temperature, transferring means for carrying the thermal development recording material to slide on each heating surface of the plurality of heating means, driving force supplying means for supplying the transferring means a driving force which is to carry the thermal development recording material, and pressing means for pressing the thermal development recording material on each heating surface of the plurality of heating means.

Furthermore, the plurality of heating means are arranged arcuately.

Furthermore, the plurality of heating means are arranged linearly.

Furthermore, the temperature adjusting means adjusts temperature of heating means, which is positioned on an uppermost stream side in a carrying direction of the thermal development recording material, out of the plurality of heating means.

Furthermore, the thermal-developing means includes: a drum, which is supported rotatablly, having heating means for applying a heating process to the thermal development recording material at a predetermined temperature on a peripheral surface, and pressing means for pressing the thermal development recording material on the peripheral surface of the drum, wherein the thermal development recording material is carried by a rotation of the drum along the peripheral surface of the drum.

DETAILED DESCRIPTION OF THE PREFERRED EMBODIMENTS

Preferred embodiments of a thermal development recording apparatus according to the present invention will be explained in detail with reference to the drawings hereinafter.

Figure 1:
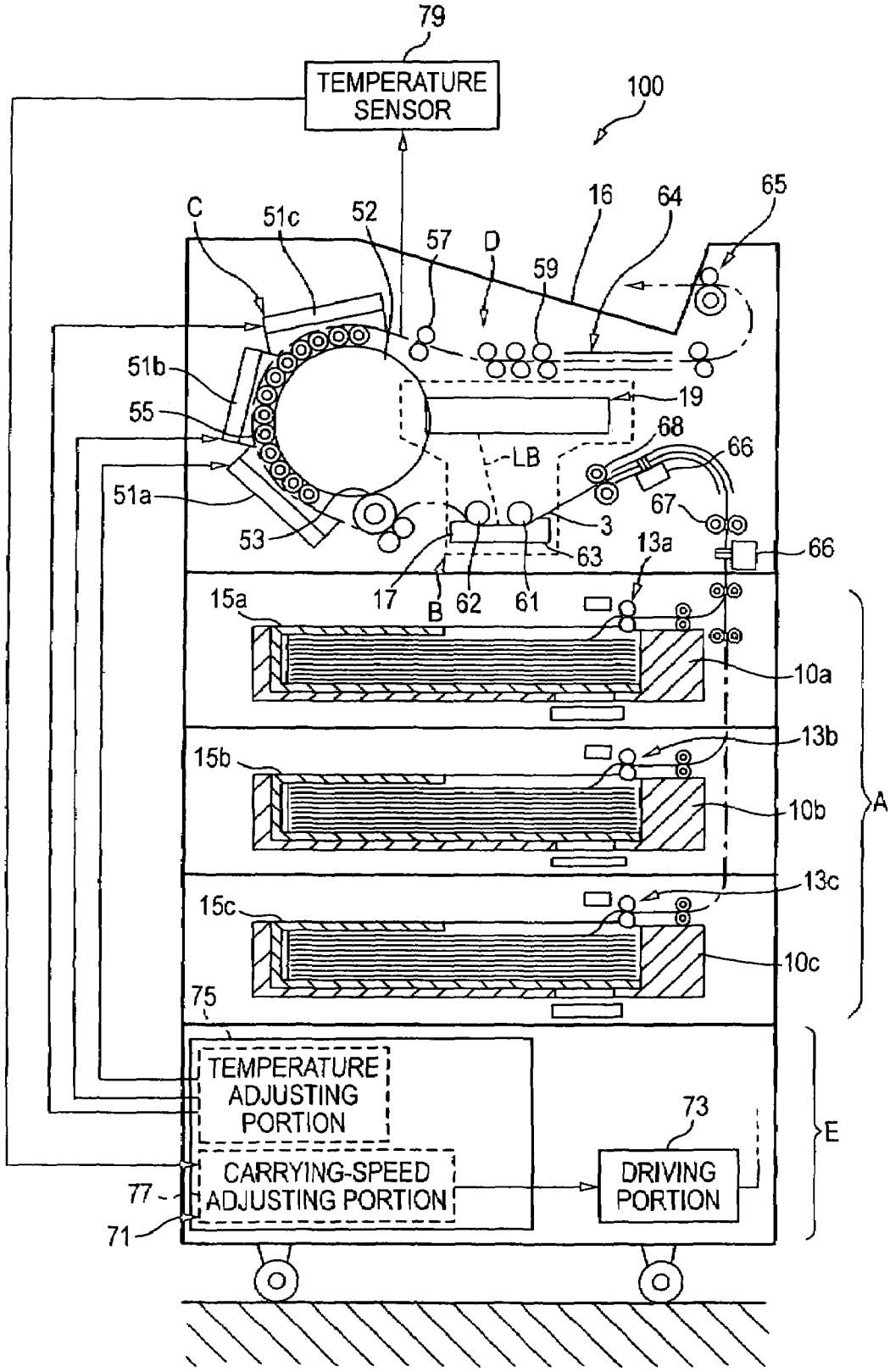
FIG. 1 is a configurative view explaining a schematic configuration of a drum type of a thermal development recording apparatus according to the present invention.
Figure 2:
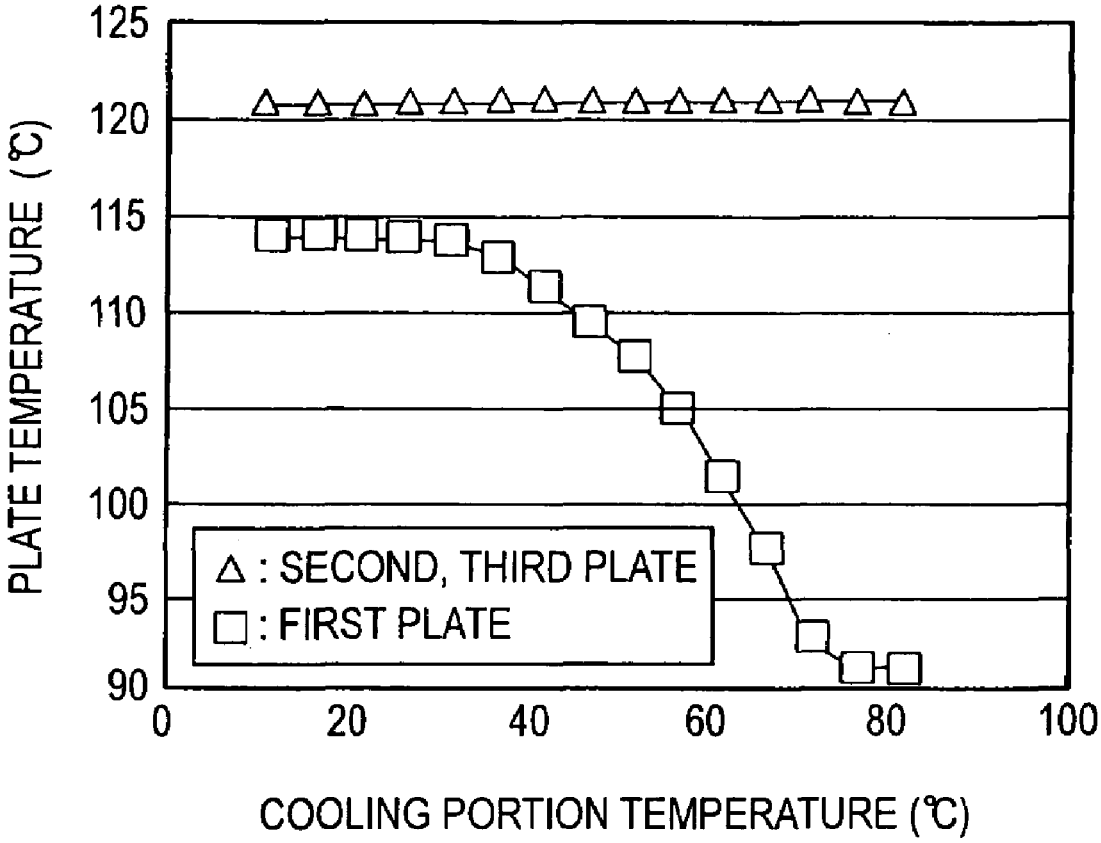
FIG. 2 is an explanatory view showing a correlation between a cooling portion temperature and a plate heater temperature.
Figure 3A:
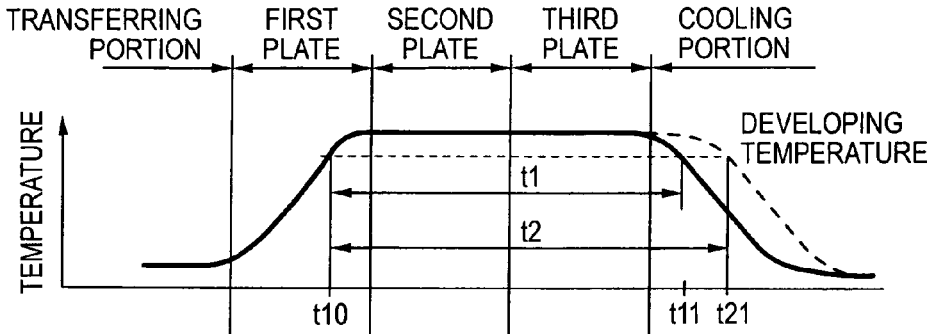
FIGS. 3A and 3B are an explanatory view showing a transition of temperature—time at a certain point on the thermal development recording material in a period when the thermal development recording material enters into a thermal-developing portion and goes away.
Figure 3B:
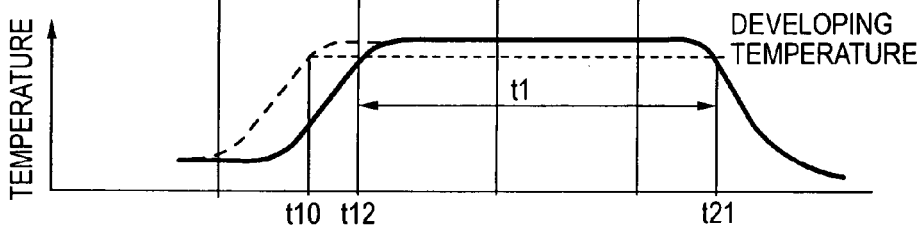

FIG. 1 is a configurative view explaining a schematic configuration of a drum type of a thermal development recording apparatus according to the present invention. FIG. 2 is an explanatory view showing a correlation between a cooling portion temperature and a plate heater temperature. FIGS. 3A and 3B are an explanatory view showing a transition of temperature-time at a certain point on the thermal development recording material in a period when the thermal development recording material enters into a thermal-developing portion and goes away.

A thermal development recording apparatus 100 forms a latent image on thermal development recording material by executing a scanning exposure while modulating an output light of an image exposing portion based on an input image signal, and then applies a thermal development processing to the thermal development recording material.

The thermal development recording apparatus 100 forms the latent image by exposing the thermal development recording material made of thermal development photosensitive material, photosensitive/thermal recording material, or the like, which does not need the wet developing process, by means of the scanning exposure using a light beam consisting of a laser beam, then obtains a visible image by executing the thermal-developing process, and then cools the recording material to an ordinary temperature.

Therefore, this thermal development recording apparatus 100 includes basically a thermal development recording material feeding portion A, an image exposing portion B, a thermal-developing portion C, and a cooling portion D in order of the carrying direction of the thermal development recording material, and also includes transferring portion provided to pertinent portions between respective portions to carry the thermal development recording material and a power supply/controlling portion E for driving and controlling respective portions.

This thermal development recording apparatus 100 is constructed such that the power supply/controlling portion E is arranged at the lowermost stage, the thermal development recording material feeding portion A is arranged thereon, and the image exposing portion (recording portion) B, the thermal-developing portion C, and the cooling portion D are arranged thereon. The image exposing portion B and the thermal-developing portion C are arranged next to each other.

According to this configuration, the exposing step and the thermal-developing step can be carried out in a short carrying distance, a carrying path length of the thermal development recording material can be shortened mostly, and also an output time required of one sheet can be shortened. Also, both the exposing step and the thermal-developing step can be applied simultaneously to a sheet of thermal development recording material.

As the thermal development recording material, thermal development photosensitive material described above, photosensitive/thermal recording material, or the like may be employed. The thermal development recording material is such a recording material that the image is recorded (exposed) on thermal development recording material by the light beam (e.g., laser beam), and then the color development is executed by the thermal development. Also, the thermal development recording material is such a recording material that the image is recorded by the light beam and then the color development is executed by the thermal development, or the image is recorded by a heat mode (heat) of the laser beam and at the same time the color development is executed and then the image is fixed by a light irradiation.

The thermal development recording material feeding portion A picks up the thermal development recording material one by one, and then supplies the thermal development recording material to the image exposing portion B that is positioned on the downstream side of the carrying direction of the thermal development recording material. Such feeding portion A is constructed to include three loading portions 10*a*, 10*b*, 10*c*, feed roller pairs 13*a*, 13*b*, 13*c* arranged in the loading portions respectively, and carrying rollers and carrying guides (not shown). Also, magazines 15*a*, 15*b*, 15*c* into which different thermal development recording materials (e.g., B4 size, half-cut size, etc.) are installed are inserted into interiors of the loading portions 10*a*, 10*b*, 10*c* constructed as three stages in such a manner that a size and a direction of the materials being loaded onto respective stages can be used selectively.

In this case, the above thermal development recording material is worked into a sheet, and normally is bound as a laminated body (bundle) in predetermined unit such as 100 sheets, or the like. The above thermal development recording materials are packaged by a bandage, a belt, or the like as a package. The package is installed into the magazine respectively, and then loaded onto respective stages of the thermal development recording material feeding portion A.

The image exposing portion B scans and exposes a light beam LB in the main scanning direction on the thermal development recording material, which is carried from the thermal development recording material feeding portion A, and also feeds the thermal development recording material in the feed direction almost perpendicular to the main scanning direction (i.e., the carrying direction of the thermal development recording material). Thus a desired image is recorded on the thermal development recording material to form the latent image.

The thermal-developing portion C carries out the thermal development by executing the temperature-up process while carrying the thermal development recording material that was subjected to the scanning exposure. Then, the thermal development recording material that was subjected to the developing process is cooled in the cooling portion D, and then is carried out onto an eject tray 16.

Here, a pushing-aside mechanism 66 is provided to the carrying path between the thermal development recording material feeding portion A and the image exposing portion B. This pushing-aside mechanism feeds the thermal development recording material, which was carried in from the thermal development recording material feeding portion A, to the image exposing portion B so as to true up the end portions in the width direction.

Next, the image exposing portion B will be explained concretely hereunder.

The image exposing portion B is a section for exposing the thermal development recording material by the scanning exposure of the light beam. The image exposing portion B includes a feed carrying portion (vertical scanning means) 17 having a fluttering preventing mechanism for carrying the thermal development recording material while preventing a fluttering of the thermal development recording material from a carrying surface, and a scanning exposing portion (laser irradiating means) 19. This scanning exposing portion 19 scans (main scan) the laser while controlling an output of the laser in compliance with image data that are prepared separately. At this time, a thermal development recording material 3 is moved in the feed direction by the feed carrying portion 17.

The feed carrying portion 17 includes two driving rollers 61, 62 arranged to put the main scanning line of the irradiated laser beam therebetween such that their axial lines are positioned in almost parallel with this scanning line, and a guide plate 63 arranged to oppose to these driving rollers 61, 62 and support the thermal development recording material 3. The guide plate 63 causes the thermal development recording material 3, which is inserted between the driving rollers 61, 62, to bend along a part of peripheral surfaces of the driving rollers on the outside between these driving rollers, which are positioned in parallel. This guide plate 63 comes into contact with the thermal development recording material 3 to receive an elastic repulsion force by these driving rollers.

The elastic repulsion force is generated in the thermal development recording material itself by this bending. A predetermined friction force is generated between the thermal development recording material 3 and the driving rollers 61, 62. Thus, a carrying/driving force is transmitted from the driving rollers 61, 62 to the thermal development recording material 3 without fail to carry the thermal development recording material 3. Accordingly, fluttering of the thermal development recording material 3 from the carrying surface, i.e., fluttering in the vertical direction can be suppressed surely. As a result, the good recording without exposure displacement can be implemented by irradiating the laser beam toward the thermal development recording material 3 between these driving rollers.

In this case, the driving rollers 61, 62 receive a driving force of a driving means (not shown) such as a motor, or the like via a transferring means such as a belt, or the like to rotate clockwise in FIG. 1.

Next, the thermal-developing portion C will be explained hereunder.

The thermal-developing portion C is an image developing portion that heats the thermal development recording material 3 on which the latent image is formed, and changes the latent image into the visible image. The thermal-developing portion C includes a cylindrical rotary drum 52 acting as a driving/transferring means, a plurality of pressing rollers 55 aligned along an outer periphery of the rotary drum 52 like a circular arc and rotated/driven by the rotary drum 52, and a first plate heater 51*a*, a second plate heater 51*b*, and a third plate heater 51*c*, which are provided outside of the pressing rollers 55, arranged along the direction that the pressing rollers 55 are arranged, that is, the feed direction of the thermal development recording material 3 to act as heating means for heating the thermal development recording material 3.

The plate heaters 51*a*, 51*b*, 51*c* aligned in the feed direction of the thermal development recording material have a concavely-curved heating surface respectively. These plate heaters 51*a*, 51*b*, 51*c* are arranged to form a series of circular arcs.

The plate heater 51*a* positioned on the uppermost stream side in the carrying direction of the thermal development recording material 3 is a preheating heater, and heats the thermal development recording material 3 to increase gradually its temperature from an ordinary temperature to a thermal-developing temperature. In contrast, the plate heaters 51*b*, 51*c* at the subsequent stage are a developing heater for heating the thermal development recording material 3 to hold it at the developing temperature.

In the thermal-developing portion C including the plate heaters 51*a*, 51*b*, 51*c*, as shown in FIG. 1, the pressing rollers 55 come into contact with the peripheral surface of the drum 52 to be rotated/driven in compliance with the rotation of the drum 52. Thus, the thermal development recording material 3 is pressed on the concave surfaces as the heating surfaces of the plate heaters and is carried relatively while sliding thereon. At this time, a feed roller 53 and a plurality of pressing rollers (pressing means) 55, which also act to transfer a heat from the plate heaters to the thermal development recording material 3, correspond to the transferring means of the thermal development recording material 3.

In this case, as the driving source of the pressing rollers 55, gears as a driving/transferring means may be provided on the shaft of the drum 52 in place of the drum 52 and then the pressing rollers 55 may be rotated/driven by the gears. In such case, the drum can be omitted. Also, an energizing means such as a spring, or the like for pressing to the plate heater side is provided to a plurality of pressing rollers 55 respectively to press the thermal development recording material 3, which is put between the plate heaters and the pressing rollers, on the heating surfaces of the plate heaters. As the pressing rollers 55, a metal roller, a resin roller, a rubber roller, or the like may be employed. According to this structure, since the thermal development recording material 3 to be carried is carried while being pressed on the plate heaters 51*a*, 51*b*, 51*c*, the buckling of the thermal development recording material 3 can be prevented.

Then, eject rollers 57 for transferring the thermal development recording material are provided to the end of the carrying path of the thermal development recording material 3 in the thermal-developing portion C.

It is of course that the above curved plate heater is an example. A configuration that employs other flat plate heater and another heating drum and includes an endless belt and a separating claw may be employed.

Then, the thermal development recording material 3 carried out from the thermal-developing portion C is cooled by the cooling portion D while paying an attention not to generate a fold and a curl. The thermal development recording material 3 discharged from the cooling portion D is guided by cooling roller pairs 59 provided in the middle of the carrying path into the guide plates 64, and then is ejected onto the eject tray 16 from the eject roller pairs 65.

In the cooling portion D, a plurality of cooling roller pairs 59 are arranged to provide a desired curvature R to the carrying path of the thermal development recording material 3. This means that the thermal development recording material 3 is carried with a constant curvature R until the thermal development recording material 3 is cooled below a glass transition point of the material. If the curvature is provided intentionally to the thermal development recording material in this manner, an extra curl is not formed before the thermal development recording material is cooled below the glass transition point, and a new curl is not formed after the thermal development recording material is cooled below the glass transition point. Thus, an amount of curl is not varied.

Next, the power supply/controlling portion E will be explained hereunder.

The power supply/controlling portion E includes a power supply portion (not shown), a control unit 71 for controlling respective portions generally, and a driving portion 73. The control unit 71 has a temperature adjusting portion 75 as temperature adjusting means, and a carrying-speed adjusting portion 77 as carrying-speed adjusting means. The temperature adjusting portion 75 and the carrying-speed adjusting portion 77 in the control unit 71 may be constructed as a sequencer or a program stored in a computer, for example. In this case, the temperature adjusting means and the carrying-speed adjusting means may be operated by another sub-control unit provided separately from the control unit 71, in addition to the control unit 71.

A temperature sensor 79 is connected to the temperature adjusting portion 75. This temperature sensor 79 senses a temperature of the cooling portion D and sends out a sensed value to the temperature adjusting portion 75. In the present embodiment, in order to sense an inlet temperature of the cooling portion D, the temperature sensor 79 is arranged on the upstream side of the carrying direction in the cooling portion D. The temperature adjusting portion 75 adjusts mainly a temperature of the first plate heater 51*a* (preheating heater) in the thermal-developing portion C, based on the temperature of the cooling portion D being inputted from the temperature sensor 79.

As shown in FIG. 2, temperature adjustment by the temperature adjusting portion 75 is given as such a control that the temperature of the first plate heater 51*a* is lowered gradually with a temperature rise in the cooling portion D. That is, as shown in FIG. 3B, the development starting time t10 required until proceed of the development is started after the thermal development recording material 3 enters into the thermal-developing portion C and is heated, is delayed to t12 by executing the adjustment to lower such temperature of the first plate heater 51*a*.

Next, an operation of the thermal development recording apparatus 100 constructed in this manner will be explained hereunder.

In the thermal development recording apparatus 100, a heat that is supplied by the removal is not accumulated in the cooling portion D at the beginning of the start of the thermal development. Therefore, the thermal development recording material 3 on which the latent image is formed in the image exposing portion B enters into the thermal-developing portion C and is heated by the plate heater 51*a*. Then, as shown in FIG. 3A, the temperature reaches the development proceeding temperature at a time t10 and then the proceed of the development is started. Then, the temperature of the thermal development recording material 3 is increased and then is maintained constant in excess of the development proceeding temperature by the temperature control of the plate heaters 51*b*, 51*c*, and then the thermal development recording material 3 is transferred from the thermal-developing portion C to the cooling portion D. The proceed of the thermal development is stopped at a time t11 in the middle of above process. As a result, the development proceeding time t1 of the thermal development recording material 3 is given as t1=t11−t10.

In contrast, when the inlet temperature of the cooling portion D is increased by the successive processing of the thermal development recording material 3, the development proceed stopping time of the thermal development recording material tends to be delayed to t21 in the conventional apparatus. In the thermal development recording apparatus 100 of the present embodiment, such temperature rise in the cooling portion D is sensed by the temperature sensor 79, and then the sensed value is fed to the temperature adjusting portion 75. The temperature adjusting portion 75 lowers only the heating temperature of the plate heater 51*a*, which is positioned on the uppermost stream side of the carrying direction of the thermal development recording material 3, based on the sensed value.

Then, as shown in FIG. 3B, the development proceed starting time that is defined by t10 until now is delayed to t12. This delay time t1–t10 is corrected to become equal to the prolonged development proceeding time t21–t11. Accordingly, since the plate heater 51*a* is subjected to the temperature adjustment, the development proceeding time t1 of the thermal development recording material 3 in the thermal-developing portion C is given by t1=t21–t12 and is not changed.

Figure 4:
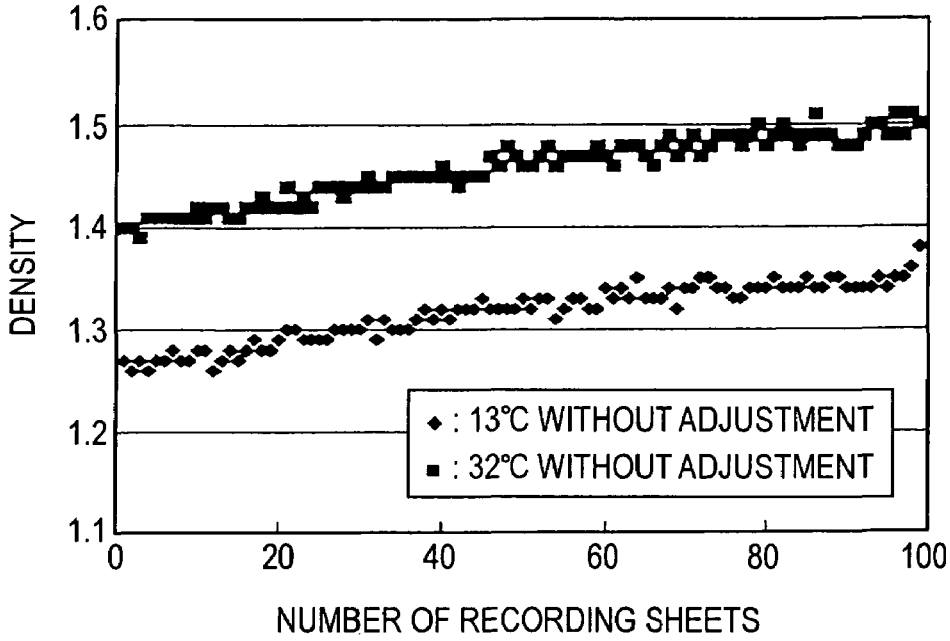
FIG. 4 is an explanatory view showing a transition of density—number of sheets of the thermal development recording material in the prior art apparatus (when temperature adjustment is not applied)
Figure 5:
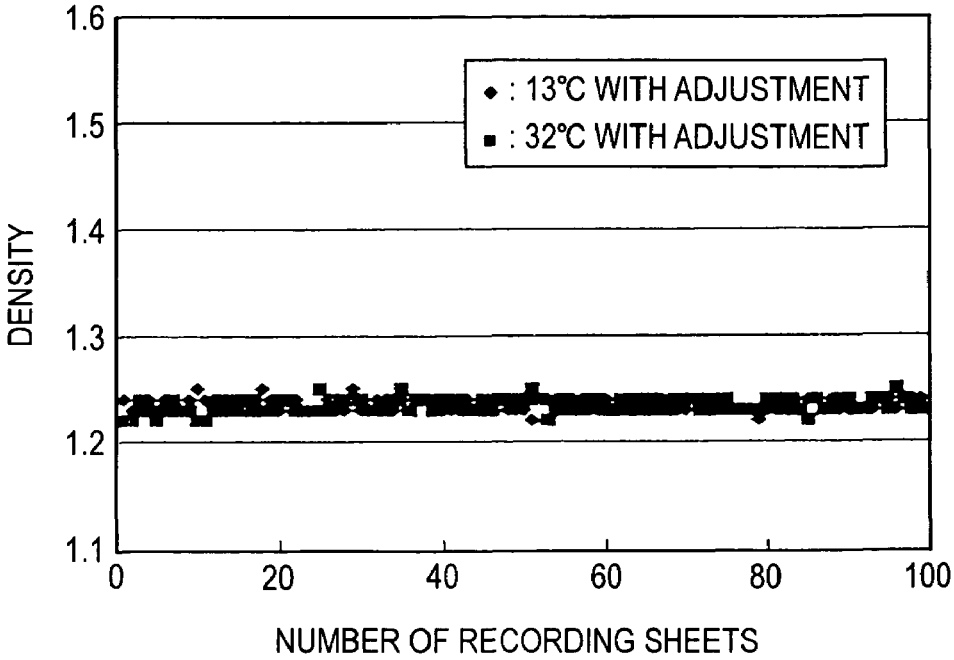
FIG. 5 is an explanatory view showing a transition of density—number of sheets of the thermal development recording material in the apparatus of the present invention (when temperature adjustment is applied)

Also, FIG. 4 is an explanatory view showing a transition of density-number of sheets of the thermal development recording material in the prior art apparatus (when temperature adjustment is not applied). FIG. 5 is an explanatory view showing a transition of density-number of sheets of the thermal development recording material in the apparatus of the present invention (when temperature adjustment is applied). Also, in both Figures, a "◆" indicates the case that an ambient temperature is 13° C., and a "■" indicates the case that an ambient temperature is 32° C. In FIG. 4, it is understood that, if the number of recording sheets of the thermal development recording materials is increased, the density is increased gradually in both cases that the ambient temperature is 13° C. and the ambient temperature is 32° C. In contrast, in FIG. 5, it is understood that, even if the number of recording sheets of the thermal development recording materials is increased, the density is always kept constant in both cases that the ambient temperature is 13° C. and the ambient temperature is 32° C.

In this manner, according to the above thermal development recording apparatus 100, the temperature adjusting portion 75 for adjusting the temperature of the thermal-developing portion C based on the temperature in the cooling portion D is provided. Therefore, if the number of recording sheets of the thermal development recording material 3 is increased and the temperature rise in the cooling portion D is caused, the temperature of the thermal-developing portion C is adjusted correspondingly and a substantial increase in the thermal-developing time is not caused. Thus, the substantial thermal-developing time can be always kept constant. As a result, not only the density can be maintained constant irrespective of the number of recording sheets of the thermal development recording material 3 but also the color tone whose change cannot be suppressed by adjusting an amount of exposure can be kept constant, and thus both the density and the color tone can be stabilized.

In this case, the development proceeding time t1 may be maintained constant by lowering the heating temperatures of the plate heaters 51*b*, 51*c* except that only the heating temperature of the plate heater 51*a* is lowered.

Next, a second embodiment of the thermal development recording apparatus according to the present invention will be explained hereunder.

Figure 6:
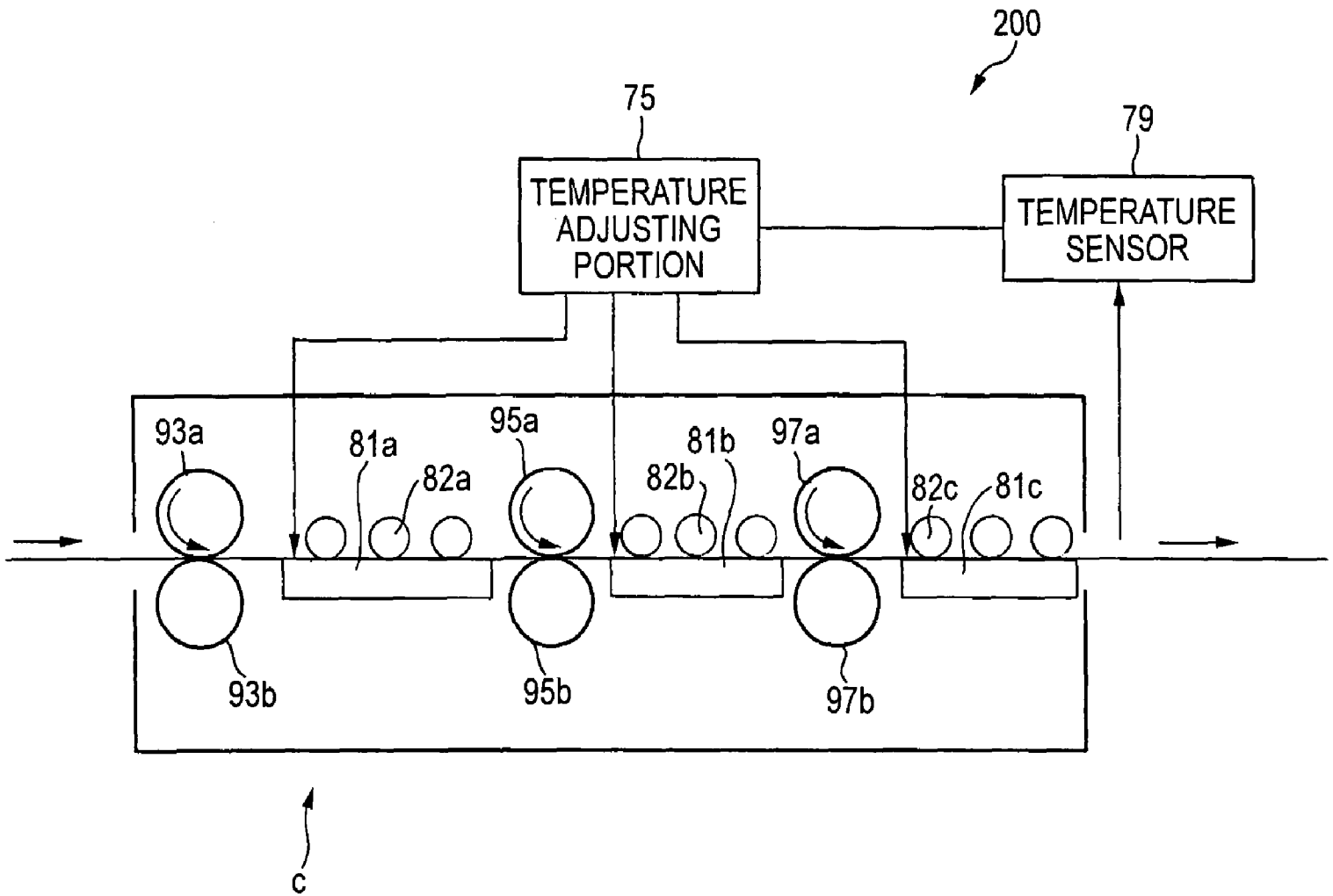
FIG. 6 is a pertinent configurative view showing the thermal-developing portion of plate heater type in the thermal development recording apparatus according to the present invention.

FIG. 6 is a pertinent configurative view showing the thermal-developing portion of plate heater type in the thermal development recording apparatus according to the present invention.

In a thermal development recording apparatus 200 of the present embodiment, the thermal-developing portion C includes a plurality of plate heaters 81*a*, 81*b*, 81*c* arranged linearly at an interval on the same flat surface as a heating means, pressing rollers 82*a*, 82*b*, 82*c* as a pressing means provided to these plate heaters 81*a*, 81*b*, 81*c* respectively to press the thermal development recording material 3, which is put between the plate heaters and the heating surfaces, on the heating surface side, and a plurality of carrying rollers 93*a*, 93*b*, 95*a*, 95*b*, 97*a*, 97*b* as a transferring means arranged alternatively with the plate heaters 81*a*, 81*b*, 81*c* to put the thermal development recording material 3 from the front and back surface sides and to transfer it linearly. These carrying rollers are provided as a pair of rollers vertically, and are rotated/driven by supplying a rotating/driving force from a driving source such as a motor, or the like via a driving/transmitting means such as gears (not shown). Also, the pressing rollers 82*a*, 82*b*, 82*c* may also be used as the driving roller, and an effect of preventing generation of the fold on the thermal development recording material 3 can be enhanced in such case.

In the present embodiment, out of the plate heaters 81*a*, 81*b*, 81*c*, the plate heater 81*a* that is positioned on the uppermost stream side in the carrying direction of the thermal development recording material 3 acts as the preheating heater, and the plate heaters 81*b*, 81*c* in the subsequent stage act as the thermal-developing heater. Also, the cooling portion (although not shown) is provided on the downstream side (right side in FIG. 6) of the thermal-developing portion C. Then, like the above first embodiment, the temperature sensor 79 and the temperature adjusting portion 75 are provided to the thermal development recording apparatus 200. The temperature sensor 79 senses the inlet temperature of the cooling portion. The temperature adjusting portion 75 adjusts mainly the temperature of the plate heater 81*a* (preheating heater) in the thermal-developing portion C based on the temperature of the cooling portion that is input from the temperature sensor 79.

Next, an operation of the thermal development recording apparatus 200 will be explained hereunder.

The thermal development recording material 3 on which the latent image is formed enters into the thermal-developing portion C and then its top end is sandwiched by a roller pair 93*a*, 93*b*. The thermal development recording material 3 is transferred rightward in FIG. 6 according to the rotation/drive of the roller pair 93*a*, 93*b*. Then, the top end of the thermal development recording material 3 comes up to the plate heater 81*a* and then heated preliminarily. Then, the top end of the thermal development recording material 3 comes up to a carrying roller pair 95*a*, 95*b*, and then is carried rightward in FIG. 6 according to the rotation/drive of the roller pair 95*a*, 95*b*. Then, the top end comes up to the plate heater 81*b* and then comes up to the plate heater 81*c* according to the rotation/drive of the roller pair 97*a*, 97*b*.

When the inlet temperature of the cooling portion is increased by the successive processing of the thermal development recording material 3, the temperature rise in the cooling portion is sensed by the temperature sensor 79 like the above, and then the sensed value is fed to the temperature adjusting portion 75. This temperature adjusting portion 75 reduces only the heating temperature of the plate heater 81*a* on the uppermost side based on the sensed value. Then, the development proceed starting temperature is delayed. As a result, like the above, the development proceeding time of the thermal development recording material 3 is not changed.

Accordingly, in the thermal development recording apparatus 200 in which the plate heaters 81*a*, 81*b*, 81*c* are provided linearly, not only the density can be maintained constant irrespective of the number of recording sheets of the thermal development recording material 3 but also the color tone whose change cannot be suppressed by adjusting an amount of exposure can be kept constant, and thus both the density and the color tone can be stabilized.

Also, the development proceeding time may be adjusted constant by lowering the heating temperatures of the plate heaters 81*b*, 81*c* except that only the heating temperature of the plate heater 81*a* is lowered.

Next, a third embodiment of the thermal development recording apparatus according to the present invention will be explained hereunder.

Figure 7:
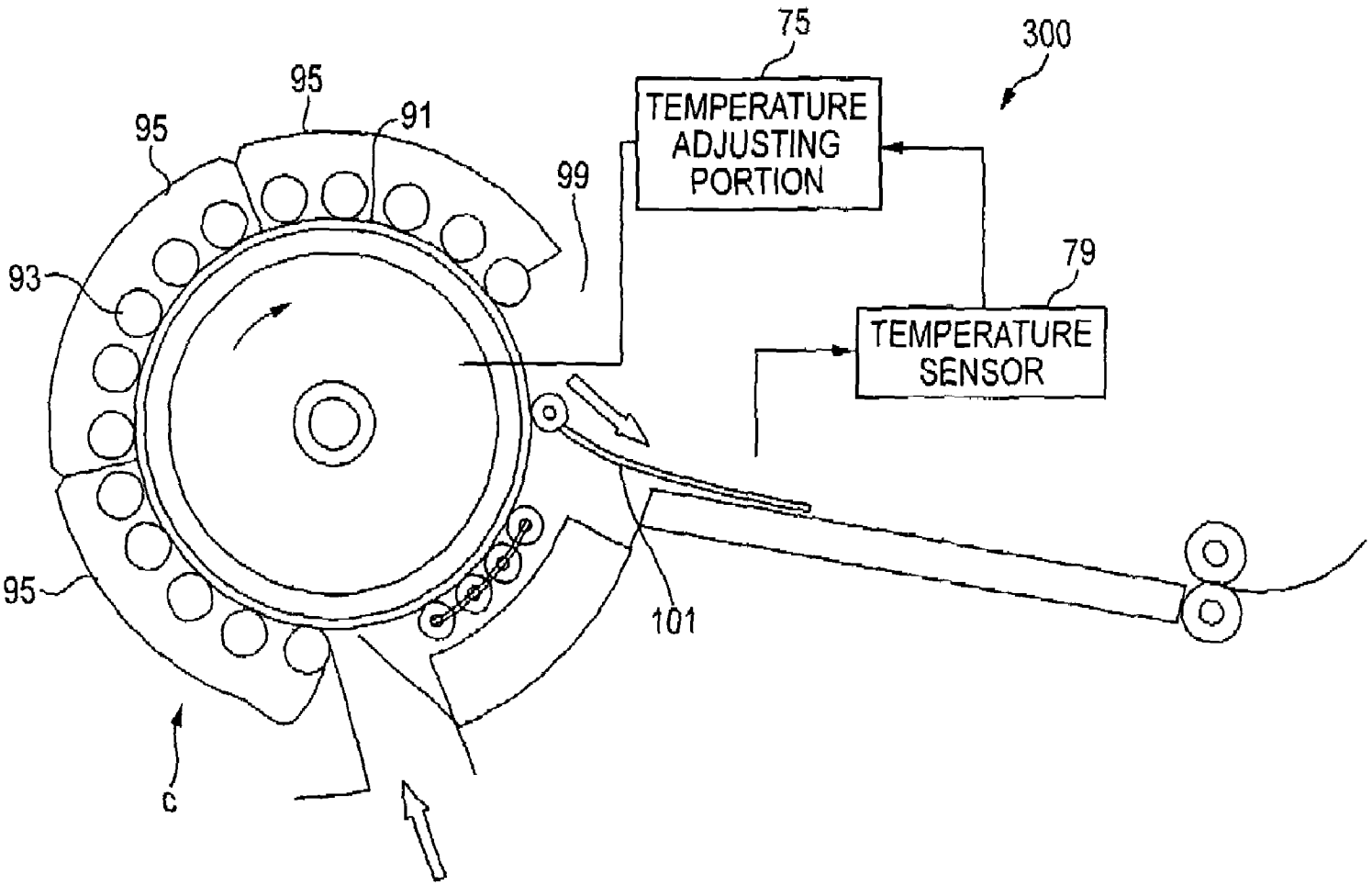
FIG. 7 is a pertinent configurative view showing the thermal-developing portion of heating drum type in the thermal development recording apparatus according to the present invention.

FIG. 7 is a pertinent configurative view showing the thermal-developing portion of heating drum type in the thermal development recording apparatus according to the present invention.

In a thermal development recording apparatus 300 of the present embodiment, the thermal-developing portion C is constructed to include a heating drum 91 for holding the thermal development recording material 3 on its outer periphery to heat it, and a plurality of rollers 93 arranged on the outside of the drum 91 in parallel with the drum 91 at an equal interval or different intervals in the peripheral direction to act as a pressing means for pressing the thermal development recording material 3 on the peripheral surface of the drum 91 to guide it.

The drum 91 is rotated clockwise in FIG. 7 to transfer the thermal development recording material 3 in the same direction. The cooling portion (not shown) is provided on the downstream side in the transferring direction. Then, the temperature sensor 79 and the temperature adjusting portion 75 are also provided to the thermal development recording apparatus 300. The temperature sensor 79 senses the inlet temperature of the cooling portion. Like the above, the temperature adjusting portion 75 adjusts the temperature of the drum 91 in the thermal-developing portion C based on the temperature of the cooling portion that is input from the temperature sensor 79.

The drum 91 is rotated in a state that it contacts tightly the thermal development recording material 3, and heats the thermal development recording material 3 to execute the thermal development. That is, the latent image formed on the thermal development recording material 3 is formed as the visible image. The drum 91 thermally develops the thermal development recording material 3 by maintaining the thermal development recording material 3 at the temperature, which is in excess of a predetermined lowest thermal-developing temperature, for a predetermined thermal-developing time Three guide brackets 95 supported by a frame (not shown) are provided to both end of the drum 91 respectively. The guide brackets 95 press the rollers 93 on the outer periphery of the drum 91 by using a spring force of coil springs (not shown). Therefore, when the thermal development recording material 3 enters into a space between the outer periphery of the drum 91 and the rollers 93, such thermal development recording material 3 is pressed on the outer peripheral surface of the drum 91 by the spring force, whereby the thermal development recording material 3 is heated and thermally developed uniformly over the entire surface.

The plate heaters (not shown), etc. are fitted to an inner periphery of the drum 91 over the full circumference as the heating means, and heat the outer periphery of the drum 91 under control of the temperature adjusting portion 75.

Next, an operation of the thermal development recording apparatus 300 will be explained hereunder.

When the thermal development recording material 3 on which the latent image is formed enters into the thermal-developing portion C, such thermal development recording material is inserted into the space between the drum 91 and the rollers 93. Then, the thermal development recording material 3 is carried in the same direction as the rotation of the drum 91, i.e., along the peripheral surface of the drum 91, while contacting the outer peripheral surface of the drum 91. At the same time, the thermal development recording material 3 is pressed on the outer peripheral surface of the drum 91 by the pressing force of the rollers 93, whereby the entire surface of the thermal development recording material 3 is heated and thermally developed uniformly. After the thermal development recording material 3 transferred together with the rotation of the drum 91 is thermally developed, such thermal development recording material comes up to an ejecting portion 99. The thermal development recording material 3 is released from the outer periphery of the drum 91 by a guiding plate 101, and then carried to the cooling portion (not shown).

When the inlet temperature of the cooling portion is increased by the successive processing of the thermal development recording material 3, the temperature rise in the cooling portion is sensed by the temperature sensor 79 like the above, and then the sensed value is fed to the temperature adjusting portion 75. This temperature adjusting portion 75 lowers the heating temperature of the drum 91 based on the sensed value. Then, the development proceed starting temperature is delayed. As a result, like the above, the development proceeding time of the thermal development recording material 3 is not changed.

Accordingly, in the thermal development recording apparatus 300 in which the heating drum 91 is provided, not only the density can be maintained constant independent of the number of recording sheets of the thermal development recording material 3 but also the color tone whose change cannot be suppressed by adjusting an amount of exposure can be kept constant, and thus both the density and the color tone can be stabilized.

Next, a fourth embodiment of the thermal development recording apparatus according to the present invention will be explained hereunder.

The thermal development recording apparatus according to the present embodiment has a configuration for adjusting a carrying speed of the thermal development recording material 3 by a transferring means, based on the temperature of the cooling portion D. This configuration will be explained by taking the case where such configuration is employed in the thermal development recording apparatus shown in FIG. 1, for example, as an example. As shown in FIG. 1, the temperature sensor 79 and the carrying-speed adjusting portion 77 are provided to this thermal development recording apparatus. The temperature sensor 79 senses the inlet temperature of the cooling portion D.

Then, the carrying-speed adjusting portion 77 sends out a rotation controlling signal of the drum 52 to the driving portion 73, which drives/controls respective transferring means, based on the temperature of the cooling portion D being input from the temperature sensor 79, and changes at least the rotation speed of the drum 52 in the thermal-developing portion C to adjust the carrying-speed of the thermal development recording material 3. In this case, when the configuration in the present embodiment is employed, an operation of the temperature adjusting portion 75 shown in FIG. 1 is paused. In other words, the thermal development recording apparatus is operated by any one function of the temperature adjusting portion 75 or the carrying-speed adjusting portion 77.

The adjustment executed by the carrying-speed adjusting portion 77 gives such a control that accelerates a rotation speed of the drum 52 gradually with an temperature rise in the cooling portion D. That is, as shown in FIG. 3A, if such adjustment to accelerate the carrying speed is executed, the substantial development proceeding time can be shortened to t1 because of the acceleration of the carrying speed even when the thermal development recording material 3 enters into the thermal-developing portion C and then the development proceed stopping time is delayed to t21 to increase the development proceeding time to t2.

Next, an operation of the thermal development recording apparatus constructed in this manner will be explained hereunder.

In the thermal development recording apparatus, a heat that is supplied by the removal is not accumulated in the cooling portion D at the beginning of the start of the thermal development. Therefore, as shown in FIG. 3A, the thermal development recording material 3 on which the latent image is formed in the image exposing portion B enters into the thermal-developing portion C and is heated by the plate heater 51*a*. Then, the temperature reaches the development proceeding temperature at a time t10 and then the proceed of the development is started. Then, the temperature of the thermal development recording material 3 is increased and is maintained constant in excess of the development proceeding temperature by the temperature control of the plate heaters 51*b*, 51*c*, and then the thermal development recording material 3 is transferred from the thermal-developing portion C to the cooling portion D. The proceed of the thermal development is stopped at a time t11 in the middle of above process. As a result, the development proceeding time t1 of the thermal development recording material 3 is given by t1=t11−t10.

In contrast, when the inlet temperature of the cooling portion D is increased by the successive processing of the thermal development recording material 3, the development proceed stopping time of the thermal development recording material becomes t21 in the prior art. As a result, the development proceeding time is given by t2=t21−t10. In the thermal development recording apparatus of the present embodiment, such temperature rise in the cooling portion D is sensed by the temperature sensor 79, and then the sensed value is fed to the carrying-speed adjusting portion 77. The carrying-speed adjusting portion 77 sends out a rotation-speed increasing signal to the driving portion 73 based on the sensed value and accelerates the carrying speed of the drum 52.

Then, the development proceed starting time that is defined by t2 until now is shortened to t1. As a result, the development proceeding time t1 of the thermal development recording material 3 is not changed.

In this way, according to the thermal development recording apparatus of the present embodiment, the carrying-speed adjusting portion 77 for adjusting the carrying speed of the drum 52 based on the temperature in the cooling portion D is provided. Therefore, if the number of recording sheets of the thermal development recording material 3 is increased and the temperature rise in the cooling portion D is caused, the carrying speed is adjusted correspondingly and a substantial increase in the thermal-developing time is not caused. Thus, the substantial thermal-developing time can be always kept constant. As a result, not only the density can be maintained constant regardless of the number of recording sheets of the thermal development recording material 3 but also the color tone whose change cannot be suppressed by adjusting an amount of exposure can be kept constant, and thus both the density and the color tone can be stabilized. Also, as the adjustment of the carrying speed, as the case may be, the carrying speed may be adjusted over the entire carrying path of the thermal development recording material 3 in the apparatus. In such case, the thermal-developing process can be executed at a higher speed and improvement in a processing capability can be achieved.

In this case, explanation is made while taking as an example the case where the present embodiment is applied to the thermal development recording apparatus 100 in the first embodiment. In addition, if the present embodiment is applied to the thermal development recording apparatus 200 and the thermal development recording apparatus 300 explained in the above second and third embodiments, the same advantages and effects as the above can be achieved.

EXAMPLES

Examined results of the density and the color tone of the recorded image when the successive recording is carried out by the thermal development recording apparatus according to the present invention are given hereunder.

TABLE 1

| | Density in successive recording | Color tone in successive recording |
|---|---|---|
| An amount of exposure is adjusted by the temperature in the cooling portion. | ○ | Δ (A reddish tinge is enhanced with the successive recording.) |
| A thermal development temperature is adjusted by the temperature in the cooling portion. | ○ | ○ |

In the comparative example in which an amount of exposure is adjusted/controlled by the temperature of the cooling portion, the density in the successive recording was good, but a reddish tinge in the color tone was enhanced together with the successive recording. In contrast, in the example as the result obtained by the thermal development recording apparatus of the present invention, the results indicating that both the density and the color tone are excellent at the time of the successive recording were obtained.

As described in detail above, according to the thermal development recording apparatus of the present invention, the temperature adjusting portion for adjusting the temperature of the thermal-developing portion based on the temperature in the cooling portion is provided. Therefore, if the number of recording sheets of the thermal development recording material is increased and the temperature rise in the cooling portion is caused, the temperature of the thermal-developing portion is adjusted correspondingly and a substantial increase in the thermal-developing time is not caused. Thus, the substantial thermal-developing time can be always kept constant. As a result, not only the density can be maintained constant irrespective of the number of recording sheets of the thermal development recording material but also the color tone whose change cannot be suppressed by adjusting an amount of exposure can be kept constant, and thus both the density and the color tone can be stabilized.

What is claimed is:

1. A thermal development recording apparatus comprising:

recording means for exposing a thermal development recording material to form a latent image;

thermal-developing means for heating the thermal development recording material to execute a thermal development;

cooling means for cooling the thermal development recording material after the thermal development; and temperature adjusting means for adjusting temperature of the thermal-developing means based on temperature of the cooling means, wherein the thermal-developing means includes a plurality of heating means, which are arranged to align in a feed direction of the thermal development recording material, for applying a heating process to the thermal development recording material at a predetermined temperature, and the temperature adjusting means adjusts temperature of heating means, which is positioned on an uppermost stream side in a carrying direction of the thermal development recording material, out of the plurality of heating means.

2. The thermal development recording apparatus according to claim 1, wherein the thermal-developing means includes:

transferring means for carrying the thermal development recording material to slide on each heating surface of the plurality of heating means;

driving force supplying means for supplying the transferring means with a driving force which is to carry the thermal development recording material; and pressing means for pressing the thermal development recording material on each heating surface of the plurality of heating means.

3. The thermal development recording apparatus according to claim 1, wherein the plurality of heating means are arranged arcuately.

4. The thermal development recording apparatus according to claim 1, wherein the plurality of heating means are arranged linearly.

5. The thermal development recording apparatus according to claim 1, wherein the thermal-developing means includes:

a drum, which is supported rotatablly, having heating means for applying a heating process to the thermal development recording material at a predetermined temperature on a peripheral surface; and pressing means for pressing the thermal development recording material on the peripheral surface of the drum, wherein the thermal development recording material is carried by a rotation of the drum along the peripheral surface of the drum.

6. The thermal development recording apparatus according to claim 1, wherein the temperature adjusting means lowers the temperature of the thermal-developing means based on the temperature of the cooling means such that the thermal development of the thermal recording development material occurs later in time than when the temperature adjusting means does not lower the temperature of the thermal-developing means.

7. The thermal development recording apparatus according to claim 1, wherein the temperature adjusting means lowers the temperature of the thermal-developing means based on the temperature of the cooling means such that the thermal development of the thermal recording development material occurs more downstream than when the temperature adjusting means does not lower the temperature of the thermal-developing means.

8. A thermal development recording apparatus comprising:

recording means for exposing a thermal development recording material to form a latent image;

thermal-developing means for heating the thermal development recording material to execute a thermal development;

cooling means for cooling the thermal development recording material after the thermal development; and temperature adjusting means for adjusting temperature of the thermal-developing means based on temperature of the cooling means, wherein the thermal-developing means comprises a plurality of heating means and the temperature adjusting means adjusts only one of the plurality of heating means.

9. The thermal development recording apparatus according to claim 8, wherein the one of the plurality of heating means is positioned on an uppermost stream side in a carrying direction of the thermal development recording material.

10. The thermal development recording apparatus according to claim 8, wherein the temperature adjusting means lowers a temperature of the one of the plurality of heating means such that a thermal development of a point on the thermal recording development material occurs later in time than when the temperature of the one of the plurality of heating means is not lowered.

11. The thermal development recording apparatus according to claim 8, wherein the temperature adjusting means lowers the temperature of the one of the plurality of heating means such that a thermal development of a point on the thermal recording development material occurs more downstream than when the temperature of the one of the plurality of heating means is not lowered.

* * * * *